US006431984B2

(12) United States Patent
Coyer et al.

(10) Patent No.: US 6,431,984 B2
(45) **Date of Patent: *Aug. 13, 2002**

(54) SECURITY SYSTEMS FOR USE IN GAMING TABLES AND METHODS THEREFOR

(75) Inventors: Christopher R. Coyer, 9105 Teal Lake Ct., Las Vegas, NV (US) 89129; William Echols, 101 S. Rainbow, No. 28-12, Las Vegas, NV (US) 89145

(73) Assignees: Christopher R. Coyer; William Echols; Harry M. Weiss; Barbara J. Coyer, all of Las Vegas, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 184 days.

(21) Appl. No.: 08/867,793

(22) Filed: Jun. 3, 1997

(51) Int. Cl.[7] ..... A63F 9/24

(52) U.S. Cl. ..... 463/29; 273/148 R; 273/309; 340/540

(58) Field of Search ..... 273/309, 148 R; 463/29, 16, 13, 12; 340/573.1, 540, 555

(56) References Cited

U.S. PATENT DOCUMENTS 3,745,550 A * 7/1973 Anthony et al.
3,789,384 A * 1/1974 Akers
3,859,648 A * 1/1975 Corbin
4,199,753 A * 4/1980 Gontowski
4,242,670 A * 12/1980 Smith
4,719,363 A * 1/1988 Gallacher
5,047,749 A * 9/1991 Segan et al.
5,130,532 A * 7/1992 Clemens
5,393,067 A * 2/1995 Paulsen et al.
5,451,054 A * 9/1995 Orenstein
5,586,766 A * 12/1996 Forte et al.
5,605,334 A * 2/1997 McCrea, Jr.
5,651,548 A * 7/1997 French et al.
5,735,742 A * 4/1998 French
5,785,321 A * 7/1998 van Putten et al.
5,831,527 A * 11/1998 Jones, II et al.

* cited by examiner

*Primary Examiner*—Michael O'Neill
(74) *Attorney, Agent, or Firm*—Harry M. Weiss; Jeffrey Weiss; Weiss & Moy, P.C.

(57) ABSTRACT

A security system for use in gaming comprises, in combination, a gaming table, and a plurality of light-sensitive detectors arranged in a pattern on the gaming table. A plurality of indicating lights is provided equal in number and electrically coupled to the plurality of light-sensitive detectors. Interruption of light otherwise passing into any one of the plurality of light-sensitive detectors causes illumination of its own corresponding indicating light to cease during the interruption of light, and the illumination to return once the interruption of light terminates. Each detector of the plurality of light-sensitive detectors comprises a Cadmium Cell detector. An alternative embodiment of the system incorporates fiber-optic cables in lieu of the Cadmium Cell detectors and their associated indicating lights.

14 Claims, 2 Drawing Sheets

SECURITY SYSTEMS FOR USE IN GAMING TABLES AND METHODS THEREFOR

BACKGROUND OF THE INVENTION

1. Field of the Invention

This invention is in the field of security systems and methods therefore and, more particularly, is a system and a method for use in detecting, and therefore deterring, unauthorized extensions of objects, including part of a player, over portions of a gaming table.

2. Description of the Related Art

Gaming or gambling has been in existence for many years, and based upon the rapid expansion of casinos in Las Vegas and elsewhere, it will continue to for many years to come. Because of the large sums of money at stake on a daily basis at a casino, security measures are extremely important. Overhead cameras are a common manner of watching the play at a given gaming table. Observation of players at a particular gaming table is also accomplished via the careful, but limited, eyes of table dealers and pit bosses. Despite security measures such as these, sophisticated thieves continue to successfully rob casino gaming tables.

A technique common amongst gaming thieves is to remove or insert one or more gambling chips depending upon the situation involved with a particular game. For example, a thief will commonly place a stack of gaming chips on the gaming table where his bet belongs, and if it becomes apparent to the thief that he has been dealt a "poor hand," he attempts to quickly and covertly knock one or more of his gaming chips off the stack of chips which he initially bet. Oftentimes, the thief will attempt to remove the highest value chip from his stack of chips. With such an approach, the thief is able to decrease his losses. Alternatively, when it becomes apparent to a thief that he has been dealt a "good hand," he will attempt to place one or more chips onto his stack of bet chips, thereby illegally increasing his winnings on that hand, assuming that he wins the hand.

As techniques such as these have been successfully used in Baccarat, Blackjack, and possibly other games, it would be advantageous to be able to detect the unauthorized presence of a player's hand, other portions of his anatomy, or other objects over the portion of the gaming table where the player's bet is placed.

Such is the primary aspect of the instant invention.

SUMMARY OF THE INVENTION

An object of the present invention is to provide a system for detecting the unauthorized extension of a player's hand, other portions of his anatomy, or other objects over a portion of a gaming table where his bet is placed and a method therefore.

Another object of the present invention to provide a system for detecting, and thereby deterring the occurrence of such unauthorized extensions over a gaming table and a method therefore.

BRIEF DESCRIPTION OF THE PREFERRED EMBODIMENTS

According to the present invention, a security system is disclosed f or use in gaming comprising, in combination, a gaming table, and a plurality of light-sensitive detectors arranged in a pattern on the gaming table. The system further includes a plurality of indicating lights equal in number to the plurality of light-sensitive detectors. Each light-sensitive detector is electrically coupled to its own corresponding indicating light. The interruption of light passing into any one of the plurality of light-sensitive detectors causes illumination of its own corresponding indicating light to cease during the interruption of light, and the illumination to return once the interruption of light terminates. Each detector of the plurality of light-sensitive detectors preferably comprises a Cadmium Cell detector. The pattern establishes a security barrier between each player at the gaming table and portions of the gaming table where players place bets. Moreover, the plurality of indicating lights are placed at a location remote from the gaming table.

An alternative embodiment of the security system further includes indicating light lock-in means coupled to the plurality of light-sensitive detectors and to the plurality of indicating lights for locking any indicating light from its normally un-illuminated condition into an illuminated condition whenever interruption of light occurs at the light sensitive detector corresponding to the particular indicating light. For the sake of clarity, note that in contrast to the previous embodiment of the system, this embodiment of the system provides that the indicating lights are normally off or un-illuminated, and on or illuminated whenever interruption of light occurs at the light sensitive detector corresponding to the particular indicating light. This second embodiment of the system further includes indicating light reset means for resetting all of the indicating lights from the illuminated condition to the un-illuminated condition (i.e., any indicating light that is illuminated is reset to the un-illuminated condition).

The indicating light lock-in means includes a plurality of relay coils equal in number to the plurality of light-sensitive detectors wherein each relay coil is electrically coupled between a first junction of its own corresponding light-sensitive detector and a first junction of its own corresponding indicating light, a plurality of pairs of contacts equal in number to the plurality of light-sensitive detectors wherein each pair of contacts corresponds to its own, separate relay coil and wherein each pair of contacts is electrically coupled between a second junction of its own corresponding light-sensitive detector and a second junction of its own corresponding indicating light, and wherein a first contact of each of the pair of contacts is normally open and a second contact of each of the pair of contacts is normally closed. When voltage at any relay coil rises above a drop out voltage, the first and second contacts corresponding to the relay coil close and open, respectively, and when voltage at the relay coil drops below the drop out voltage, the first and second contacts corresponding to the relay coil open and close, respectively. The indicating light reset means includes a reset push-button having one junction electrically coupled to a voltage supply.

A third embodiment of the security system for use in gaming comprises, in combination, a gaming table, and a plurality of fiber-optic cables each having a first end arranged in a pattern on the gaming table. In this embodiment of the system, a second end of each of the fiber-optic cables is placed at a location remote from the gaming table. Moreover, interruption of light passing into the first end of any one of the plurality of fiber-optic cables causes illumination at the corresponding second end of any one of the plurality of fiber-optic cables to cease during the interruption of light, and the illumination to return once the interruption of light terminates. The pattern establishes a security barrier between each player at the gaming table and portions of the gaming table where players place bets.

A forth embodiment of the instant invention discloses a method of detecting unauthorized extensions of objects over portions of a gaming table comprising the steps of providing a gaming table, and embedding a plurality of light-sensitive detectors arranged in a pattern on the gaming table. The plurality of light-sensitive detectors comprises one of a plurality of Cadmium Cell detectors and first ends of a plurality of fiber-optic cables. This method further comprises the steps of coupling a plurality of indicating lights to the plurality of Cadmium Cell detectors, one indicating light per detector, and placing the indicating lights at a location remote from the gaming table. Alternatively, this method further comprises the step of placing second ends of the plurality of fiber-optic cables at a location remote from the gaming table.

The foregoing and other objects, features, and advantages of the invention will be apparent from the following, more particular, description of the preferred embodiments of the invention, as illustrated in the accompanying drawings.

DESCRIPTION OF THE PREFERRED EMBODIMENTS

Figure 1:
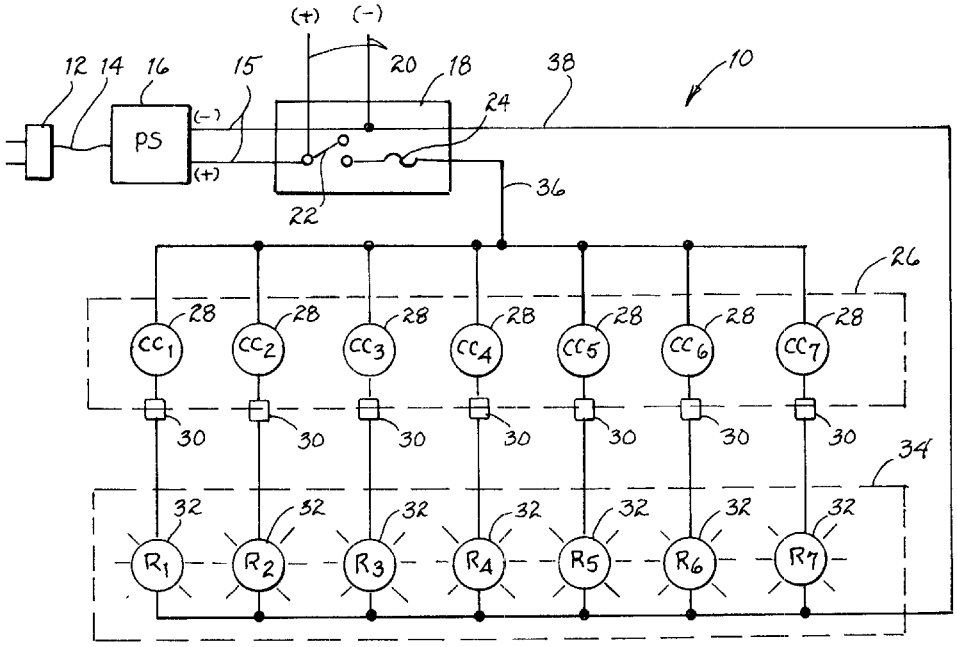
FIG. 1 is a simplified electrical schematic showing one embodiment of the instant security system.

Referring to FIG. 1, a simplified electrical schematic shows one embodiment of the instant security system which is generally designated by reference number 10. In this embodiment of the security system 10, an adapter 12 is provided for connection to an external power supply (not shown) such as a wall outlet providing 120 Volt, 60 Hertz, single phase AC power. The adapter 12 is coupled via a connecting cable 14 to a power adapter 16, which transforms its input signal to an output of approximately 9 Volts DC. Such power adapters 16 are well known to those skilled in the art. The 9 Volt DC and common outputs from the power adapter 16 are coupled via connecting cables 15 to a switch box 18. The switch box 18 contains a switch 22 for controlling application of power to the remainder of the circuitry in the security system 10. The switch box 18 also contains a fuse 24 in series with the switch 22 for protecting the system 10 from an overload condition. Note also that the switch box 18 has 9 Volt DC and common outputs 20 for supplying other circuits similar to that shown in FIG. 1. These other similar circuits would be identical to that shown in FIG. 1 but for the fact that they would not include an adapter 12, connectors 14 and 15, and power adapter 16. Moreover, whereas the circuit shown in FIG. 1 would provide security for seven locations on a first gaming table 26, other similar circuits would provide security for other gaming tables (not shown). Additionally, note that the security system 10 shown in FIG. 1 provides detection capability at seven locations on a gaming table, however, the number of detection locations need not be limited to seven. Clearly, a circuit analogous to that shown in FIG. 1, could be composed which provides more or less than seven detection locations on a gaming table 26.

Figure 4:
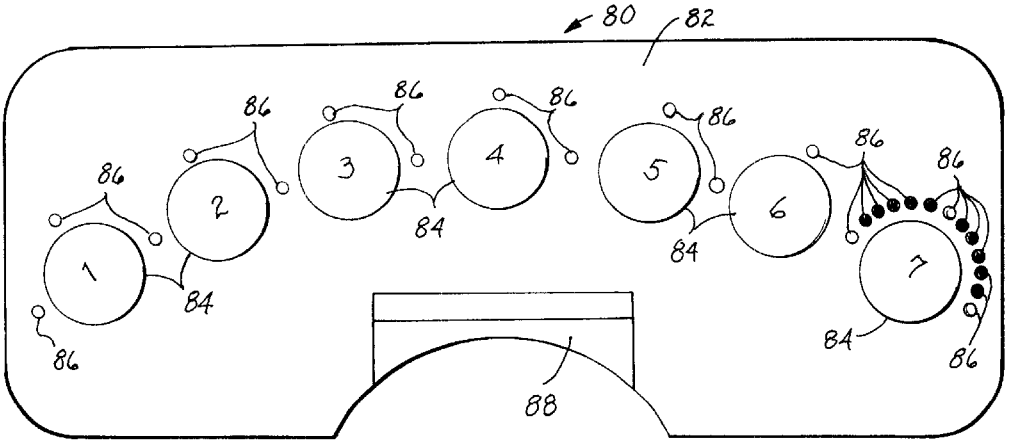
FIG. 4 is a simplified planar view of a typical Blackjack gaming table showing, by way of example, some of the patterns that could be established by the light-sensitive detectors or fiber-optic cable ends.
Figure 5:
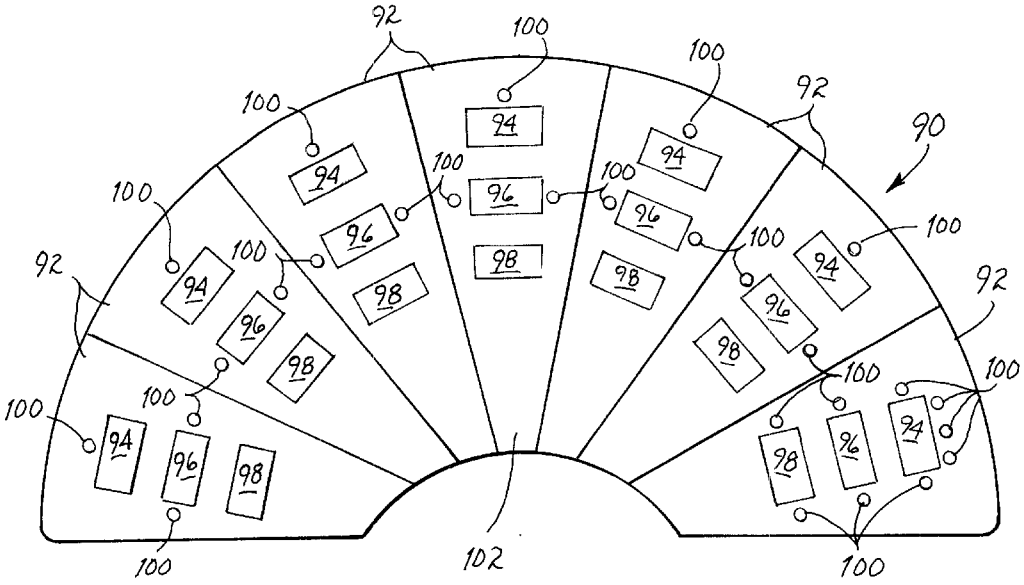
FIG. 5 is a simplified planar view of a typical Baccarat gaming table showing, by way of example, some of the patterns that could be established by the light-sensitive detectors or fiber-optic cable ends.

Still with reference to FIG. 1, the 9 Volt DC output of the switch box 18 is coupled via connection 36 to a plurality of light-sensitive detectors 28 arranged in a pattern on a gaming table 26. Each detector 28 of the plurality of light-sensitive detectors 28 preferably comprises a Cadmium Cell detector; however, those skilled in the art recognize that substantially equivalent light-sensitive detectors could be implemented, if desired. Additionally, note that the previously mentioned pattern establishes a security barrier between each player at the gaming table 26 and portions of the gaming table 26 where players place bets. While the instant security system 10 has been designed with an eye toward use with Blackjack and Baccarat gaming tables, it is considered within the scope of the claimed invention that other gaming tables or gaming surfaces could incorporate the claimed system. Also, note that while the gaming table 26 is represented in FIG. 1 by the box shown in phantom around the plurality of light-sensitive detectors 28, more typical representations of Blackjack and Baccarat tables are shown in FIGS. 4 and 5, respectively.

The security system 10 further includes a plurality of indicating lights 32 equal in number to and electrically coupled to the plurality of light-sensitive detectors 28. The plurality of indicating lights 32 are placed at a location 34 remote from the gaming table 26. The remote indicating light location 34 is represented by a box in phantom surrounding the plurality of indicating lights 32. Male/Female connectors 30 permit connection between the plurality of indicating lights 32 and the plurality of light-sensitive detectors 28. The male/female connectors 30 are shown located in proximity to the gaming table 26; however, they could be located closer to the remote indicating light location 34, if desired. Each of the indicating lights 32 is coupled via connection 38 back to the common output of the switch box 18.

Figure 2:
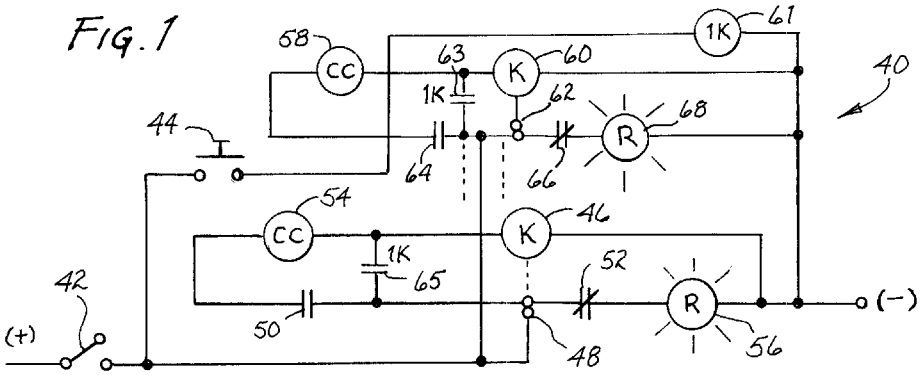
FIG. 2 is a simplified electrical schematic showing a plurality of indicating light lock-in portions and an indicating light reset portion for use in an alternative embodiment of the instant security system.

Referring to FIG. 2, a simplified electrical schematic shows an alternative embodiment of the security system generally designated by reference number 40. In this embodiment of the security system 40, it is understood that a power supply and common are provided to the circuit in any one of a number of manners well known to those skilled in the art. For the sake of simplicity, one can assume that security system 40 receives a 9 Volt DC and common supply as did security system 10 of FIG. 1. It should be noted at the outset that the operation of the security systems 10 and 40 differ. In particular, as will be discussed in detail below, for security system 10, a security violation is indicated by one or more indicating lights 32 going off during the period of the violation, and returning to their on condition once the violation ceases. In contrast, security system 40 indicates a security violation by one or more of its indication lights 56 or 68 going on once a violation has occurred, and remaining on until a user resets all such indicating lights 56 and/or 68 to their off condition.

Still with reference to FIG. 2, a switch 42 is provided for connecting the circuit to the positive power supply. A reset push-button 44 is coupled at a first junction thereof to the switch 42, and at its other junction to a coil 61 of a triggering relay wherein the triggering relay comprises the coil 61 and associated contacts 63 and 65. The triggering relay is preferably of the multi-pole, single-throw type well known to those skilled in the art. In particular, coil 61 could handle up to four separate contacts such as 63 and 65. Here, only two contacts 63 and 65 are shown for simplification of the drawing; however, those skilled in the art will recognize that more than two such contacts 63 and 65 could be implemented, if desired. For example, if more than two light-sensitive detectors 54 and 58 (as shown) were to be used (which would be the typical case because, as previously stated, only two are shown here for simplification of the drawing), then an equal number of contacts such as 65 and 63 would be implemented, each of such contacts being independently dedicated to its own corresponding light-sensitive detector such as 54 and 58. Thus, coil 61 could serve up to four contacts such as 63 and 65. If more than four light-sensitive detectors such as 54 and 58 were implemented (as would be the normal case), then more than one triggering relay coil 61 would be required. Each additional triggering relay coil would be connected in parallel with coil 61, and each would have its own associated contacts, such as 63 and 65, for resetting corresponding light-sensitive detectors such as 54 and 58 and associated indicating lights such as 56 and 68. Thus, by way of example only, if eight light-sensitive detectors such as 54 and 58 were used, then there would be two triggering relay coils such as 61, in parallel, and eight triggering relay contacts connected like contacts 63 and 65 on a one per light-sensitive detector basis. This will become apparent following the discussion of the operation of the system 40, infra. In lieu of using two four-pole, single-throw relay coils 61 for eight light-sensitive detectors, those skilled in the art will recognize multitudes of methods of accomplishing the same result such as using a single eight-pole relay, or a single eight-pole manual switch.

A light-sensitive detector 54 is coupled to the coil 46 of a relay. The relay is preferably a single pole, double throw switch manufactured by the ECG Phillips Corporation under part number RLY 5721. The relay includes the relay coil 46, the relay switch 48, normally open contact 50, and normally closed contact 52. Note that the line shown in phantom between the coil 46 and the switch 48 is intended to show that the switch 48 is controlled by the voltage sensed at the coil 46. Note that this particular relay is shown by way of example, and therefore, those skilled in the art will recognize that equivalent relays, switches, or the like could be integrated to perform the same function with the security system 40, if desired. Located between the relay coil 46 and normally open contact 50 is the light-sensitive detector 54, and located between the relay coil 46 and the normally closed contact 52 is an indicating light 56.

For each position at a gaming table (not shown) requiring security detection capability, a light-sensitive detector 54, a relay, a contact 65 associated with a triggering relay coil 61, and an indicating light 56 are required. Thus, the light-sensitive detector 58, relay (i.e. relay coil 60, switch 62, normally open contact 64, and normally closed contact 66), contact 63 associated with triggering relay coil 61, and indicating light 68 cover a separate position on a gaming table. The dashed vertical lines in the middle of the circuit indicate that a plurality of such a combination of elements (i.e. a light-sensitive detector, a relay, a contact associated with a triggering relay, and an indicating light) could, and normally would, be coupled to a triggering relay coil 61, and to the positive and common supplies of the circuit to provide security detection capability at a plurality of positions at a gaming table.

As previously noted, this embodiment of the security system 40 includes an indicating light lock-in portion which is coupled to the plurality of light-sensitive detectors 54 and 58 and to the plurality of indicating lights 56 and 68 for locking any indicating light 56 and/or 68 from its normally un-illuminated condition into an illuminated condition whenever interruption of light occurs at the light sensitive detector 54 and/or 58 corresponding to the particular indicating light 56 and/or 68.

The indicating light lock-in portion includes a plurality of relay coils 46 and 60 equal in number to the plurality of light-sensitive detectors 54 and 58 wherein each relay coil 46 and 60 is electrically coupled between a first junction of its own corresponding light-sensitive detector 54 and 58 and a first junction of its own corresponding indicating light 56 and 68, respectively. The indicating light lock-in portion also includes a plurality of pairs of contacts (50 and 52) and (64 and 66) equal in number to the plurality of light-sensitive detectors 54 and 58 wherein each pair of contacts (50 and 52) and (64 and 66) corresponds to its own, separate relay coil 46 and 60 and wherein each pair of contacts (50 and 52) and (64 and 66) is electrically coupled between a second junction of its own corresponding light-sensitive detector 54 and 58 and a second junction of its own corresponding indicating light 56 and 68, respectively. A first contact 50 and 64 of each of the pair of contacts (50 and 52) and (64 and 66) is normally open and a second contact 52 and 66 of each of the pair of contacts (50 and 52) and (64 and 66) is normally closed.

As previously noted, this embodiment of the security system 40 also includes an indicating light reset portion for resetting all of the indicating lights 56 and 68 (i.e., those indicating lights 56 and/or 68 that are lit) from the illuminated condition to the un-illuminated condition. The indicating light reset portion includes a reset push-button 44 having one junction electrically coupled to a voltage supply and an opposite junction electrically coupled to one or more triggering relay coils such as 61.

Figure 3:
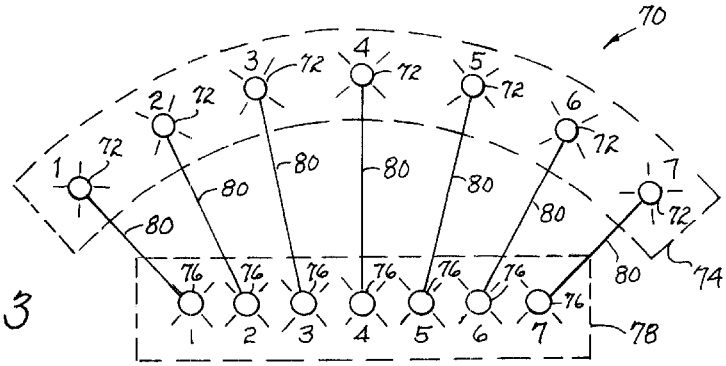
FIG. 3 is a simplified electrical schematic showing a third embodiment of the instant security system, which incorporates fiber-optic cables.

Referring to FIG. 3, a simplified electrical schematic shows a third embodiment of the instant security system, which incorporates fiber-optic cables 80, and which is generally designated by reference number 70. Security system 70 comprises a gaming table (as represented by dashed lines enclosing an area 74), and a plurality of fiber-optic cables 80 each having a first end 72 arranged in a pattern on the gaming table 74. The fiber-optic cables preferably comprise fiber-optic cables manufactured by the Lumenyte International Corporation under part number EL 200; however, those skilled in the art will recognize that other fiber-optic cables could be implemented, if desired. A second end 76 of each of the fiber-optic cables 80 is placed at a location (as represented by the dashed lines enclosing area 78) remote from the gaming table 74.

Referring to FIG. 4, a simplified planar view of a typical Blackjack gaming table 80 is shown. The Blackjack gaming table 80 has a surface 82 including, by way of example, seven areas 84 on the surface 82 where up to seven players place their bets, and where the player's cards are placed by a dealer. Also shown at the Blackjack gaming table 80 is the bank 88 where the dealer keeps the house chips, and the cards for playing the game. Situated in proximity to each of the areas 84 are a plurality of light-sensitive detectors 86. Areas one through six have a three detector 86 pattern substantially forming a security barrier between each player (not shown) at the table 80 and their respective areas 84 for placing their bets. The area 84 numbered seven has thirteen light-sensitive detectors 86 forming an arc-shaped security area between the player at position seven and his area seven for placing his bets. It should be pointed out that the patterns of light-sensitive detectors 86 shown at table 80 are shown by way of example only. The term "pattern" as used in the claims is intended to cover all arrangements of light-sensitive detectors 86 on the table 80 which could be used to effectively detect and deter unauthorized extensions of a player or some object into the areas 84 for placing bets. Moreover, note that any one of the security systems 10, 40, or 70 could be implemented with the Blackjack gaming table 80. Thus, the light-sensitive detectors 86 could be either the light-sensitive detectors disclosed with respect to the security systems 10 and 40, or alternatively could comprise first ends 72 of a plurality of fiber-optic cables 80, as disclosed with respect to security system 70.

Referring to FIG. 5, a simplified planar view of a typical Baccarat gaming table is shown and is generally designated by reference number 90. The table 90 has seven sectors for a total of seven players; however, as was the case with the Blackjack gaming table 80, more or less than seven player positions could be implemented, if desired. Each of the seven playing positions at the Baccarat table 90 have a player 94, bank 96, and tie 98 position for placing their bets in accordance with the rules of Baccarat. The table 90 also includes a rack area 102 where the dealer keeps cards and the house stack of chips. Each of the three positions 94–98 where a player can place a bet at each of the seven locations on the table 90 are circumscribed by a plurality of light-sensitive detectors 100. As set forth above with respect to the Blackjack gaming table 80, the light-sensitive detectors 100 here could be of either the type implemented in security systems 10 and 40, or ends 72 of fiber-optic cables 80 in security system 70. Moreover, the patterns set forth in FIG. 5, as in FIG. 4, are merely exemplary, and the term "pattern" in the claims is intended to encompass all arrangements of light-sensitive detectors 100 which establish a security barrier between each player at the table 90 and the positions 94–98 where their bets are placed.

Operation

410 Referring to FIG. 1, the adapter 12 is plugged into an external power supply (not shown) such as a wall outlet providing 120 Volt, 60 Hertz, single phase AC power. The adapter 12 is coupled via a connecting cable 14 to a power adapter 16, which transforms its input signal to an output of approximately 9 Volts DC. The 9 Volt DC and common outputs from the power adapter 16 are coupled via connecting cables 15 to a switch box 18. The switch box 18 switch 22 is closed to apply power to the remainder of the circuitry in the security system 10. It should be pointed out that the light-sensitive detectors 28 such as Cadmium Cell detectors 28 are either placed atop a gaming table 26 upper surface, or embedded into the upper surface. Whether the light-sensitive detectors 28 are coupled to the gaming table 26 in these or other manners, the key is that they must have adequate access to the ambient light in the gaming facility. Moreover, note that the light-sensitive detectors 28 may be arranged as shown in FIGS. 4 or 5 or as would be appropriate to establish the desired security barrier at the gaming table 26. Additionally, note that while the FIG. 1 shows only seven light-sensitive detectors 28, more could be incorporated by way of a larger, but similar circuit, to provide all, or more, of the detectors 86 and 100 shown in FIGS. 4 or 5.

Now, with the male/female connectors 30 connected as shown in FIG. 1, the power from the switch box 18 passes through each of the light-sensitive detectors 28 and their corresponding indicating lights 32. It should be pointed out that any one of a number of indicating lights 32 well known to those skilled in the art could be implemented. The power flowing through the indicating lights 32 causes them to be on or illuminated. Whenever a player passes a portion of his anatomy or some other object over a light-sensitive detector 28, he blocks the ambient light from entering a particular light-sensitive detector 28. Interruption of light passing into any one of the plurality of light-sensitive detectors 28 causes illumination of its own corresponding indicating light 32 to cease during the interruption of light. This is so because interruption of ambient light passing into any one of the light-sensitive detectors 28 causes its resistance to increase, thereby dropping more voltage across the light-sensitive detector 28. As more voltage is dropped across the light-sensitive detector 28, insufficient voltage is applied across that light-sensitive detector's 28 indicating light 32 to keep the indicating light 32 on; thus, the indicating light 32 goes off. In an analogous but reciprocal manner, when the interruption of light ceases at that light-sensitive detector 28, the illumination returns for the corresponding indicating light 32. There are times that a player may permissibly break a security barrier formed by the light-sensitive detectors 28; however, there are obviously other times when such activity is not authorized. Thus, one who monitors the indicating lights 32 at the remote location 34 and who has knowledge of the game being played at the gaming table 26 can detect such unauthorized reaching of a player into the area where his bet is placed. At that time, appropriate action can be undertaken by casino security.

Referring to FIG. 2, the positive and common power supplies can be provided in a manner analogous to that discussed with respect to FIG. 1, or in any other one of a number of manners well known to those skilled in the art. Next, a user closes switch 42 to permit operation of the security system 40. Note that the light-sensitive detectors 54 and 58 such as Cadmium Cell detectors are either placed atop a gaming table upper surface, or embedded into the upper surface. Whether the light-sensitive detectors 54 and 58 are coupled to the gaming table in these or other manners, the key is that they must have adequate access to the ambient light in the gaming facility. Moreover, note that the light-sensitive detectors 54 and 58 may be arranged as shown in FIGS. 4 or 5 or as would be appropriate to establish the desired security barrier at the gaming table. Additionally, note that while FIG. 2 shows only two light-sensitive detectors 54 and 58, more could be incorporated by way of a larger, but similar circuit, to provide all, or more, of the detectors 86 and 100 shown in FIGS. 4 or 5.

In normal operation, the indicating lights 56 and 68 are off or un-illuminated. One or more of the indicating lights 56 and/or 68 will go on, and remain on until reset, whenever a player or some object breaks the beam of ambient light passing into the corresponding one of the light-sensitive detectors 54 and/or 58. To start monitoring, a user depresses the reset push-button 44. This causes power to flow from the closed switch 42, through the reset push-button 44, and the triggering relay coil(s) 61. Power flowing through the coil(s) 61 causes triggering relay contacts 63 and 65 to shut while the push-button 44 is closed. Thus, power flows through the relay coils 46 and 60, and to the common supply for the circuit. When sufficient power (i.e. a voltage above the drop out voltage for the relays) flows through the relay coils 46 and 60, the switches 48 and 62 cause the normally open contacts 50 and 64 to shut, and the normally closed contacts 52 and 66 to open. When the reset push-button 44 is released to the open position, current flowing through the triggering relay coil(s) 61 ceases, and the contacts 63 and 65 open.

Then, power flows through the switch 42, through normally open contacts 50 and 64 (now held closed by relay coils 46 and 60), through the light-sensitive detectors 54 and 58, through the relay coils 46 and 60, and to the common supply. This flow path is maintained by the relay coils 46 and 60 sensing sufficient voltage to hold normally open contacts 50 and 64 shut, and normally closed contacts 52 and 66 open.

When a player or some other object blocks the ambient light passing into any one of the light-sensitive detectors 54 or 58, the resistance of the light-sensitive detectors 54 or 58 increases, causing a greater voltage drop across the light-sensitive detectors 54 or 58. Accordingly, less voltage is dropped across the associated relay coils 46 or 60, and when the voltage drop across the associated relay coils 46 or 60 drops below the drop out voltage for the relay, the relay switches 48 or 62 causes the normally open contacts 50 or 64 (previously shut) to open and the normally closed contacts 52 or 66 (previously open) to close, thereby altering the flow path of the circuit. The new flow path causes power to flow from the switch 42, through the normally closed contacts 52 or 66, to the indicating lights 56 or 68, and to the common supply, thereby causing the indicating lights 56 or 68 to come on and remain on until reset. One who monitors the indicating lights 56 and 68 at a remote location and who has knowledge of the game being played at the gaming table can detect unauthorized reaching of a player into the area where his bet is placed. At that time, appropriate action can be undertaken by casino security. Of course, authorized reaching into the betting zones such as will occur when a player initially places his bet will also cause the indicating lights 56 or 68 to go on, but coordination between the dealer and casino security will permit detection and deterrence of only the unauthorized reaching into the betting zone. Such coordination will be required in the implementation of all embodiments of the security system 10, 40, and 70. Resetting the circuit simply entails pressing the reset push-button 44, which causes the original flow path to be re-established, thereby turning off all indicating lights 56 and/or 68 that were lit. Note that security systems 10 and 40 can be used to cover a plurality of positions at a plurality of gaming tables, and unauthorized reaching of a player at any one position will be reflected by either turning off that one indicating light 32 associated with that particular position (as in the case of FIG. 1) or turning on and locking on until reset the indicating light 56 or 68 associated with that particular position (as in the case of FIG. 2).

Referring to FIG. 3, note that no external power supply is needed. The ambient light passing into the first end 72 of any fiber-optic cable 80 causes that illumination to be visible at the second end 76 of that cable 80. Similarly, interruption of light otherwise passing into the first end 72 of any one of the plurality of fiber-optic cables 80 causes illumination at the corresponding second end 76 of the particular of fiber-optic cable(s) 80 to cease during the interruption of light, and the illumination to return once the interruption of light terminates. One who monitors the second ends 76 of the fiber-optic cables 80 at a remote location and who has knowledge of the game being played at the gaming table can detect unauthorized reaching of a player into the area where his bet is placed. At that time, appropriate action can be undertaken by casino security.

Although the invention has been particularly shown and described with reference to a preferred embodiment thereof, it will be understood by those skilled in the art that changes in form and detail may be made therein without departing from the spirit and scope of the invention. For example, an embodiment of the instant system wherein indication of a violation is provided by an indicating light going on could be provided with the light going off, or vice versa. Additionally, those skilled in the art recognize that the electronic components used here could be replaced with solid state or integrated circuit components and be operated at other than 9 Volts DC.

What is claimed is:

1. A security system for use in gaming comprising, in combination:

a gaming table;

a plurality of light-sensitive detectors arranged in a pattern on said gaming table; and a plurality of indicating lights equal in number to said plurality of light-sensitive detectors, each light-sensitive detector is electrically coupled to its own corresponding indicating light, wherein interruption of light passing into a any one of said plurality of light-sensitive detectors causes illumination of its own corresponding indicating light to cease during said interruption of light, and said illumination to return once said interruption of light terminates, said pattern establishes a security barrier between each player at said gaming table and portions of said gaming table where players place bets.

2. The system of claim 1 wherein each detector of said plurality of light-sensitive detectors comprises a Cadmium Cell detector.

3. The system of claim 1 wherein said plurality of indicating lights are placed at a location remote from said gaming table.

4. The system of claim 1 further including indicating light lock-in means coupled to said plurality of light-sensitive detectors and to said plurality of indicating lights for locking any indicating light from its normally un-illuminated condition into an illuminated condition whenever interruption of light occurs at said light sensitive detector corresponding to said any indicating light.

5. The system of claim 4 further including indicating light reset means for resetting all of said indicating lights in said illuminated condition from said illuminated condition to said un-illuminated condition.

6. The system of claim 4 wherein said indicating light lock-in means includes:

a plurality of relay coils equal in number to said plurality of light-sensitive detectors wherein each relay coil is electrically coupled between a first junction of its own corresponding light-sensitive detector and a first junction of its own corresponding indicating light;

a plurality of pairs of contacts equal in number to said plurality of light-sensitive detectors wherein each pair of contacts corresponds to its own, separate relay coil and wherein each pair of contacts is electrically coupled between a second junction of its own corresponding light-sensitive detector and a second junction of its own corresponding indicating light; and wherein a first contact of each of said pair of contacts is normally open and a second contact of each of said pair of contacts is normally closed.

7. The system of claim 6 wherein when voltage at any relay coil rises above a drop out voltage, said first and second contacts corresponding to said any relay coil close and open, respectively, and wherein when voltage at said any relay coil drops below said drop out voltage, said first and second contacts corresponding to said any relay coil open and close, respectively.

8. The system of claim 5 wherein said indicating light reset means includes a reset push-button having one junction electrically coupled to a voltage supply.

9. A security system for use in gaming comprising, in combination:

a gaming table; and a plurality of fiber-optic cables each having a first end arranged in a pattern on said gaming table, wherein interruption of light passing into said first end of any one of said plurality of fiber-optic cables causes illumination at a second end of said any one of said plurality of fiber-optic cables to cease during said interruption of light, and said illumination to return once said interruption of light terminates, said pattern establishes a security barrier between each player at said gaming table and portions of said gaming table where players place bets.

10. The system of claim 9 wherein a second end of each of said fiber-optic cables is placed at a location remote from said gaming table.

11. A method of detecting unauthorized extensions of objects over portions of a gaming table comprising the steps of:

providing a gaming table;

embedding a plurality of light-sensitive detectors arranged in a pattern on said gaming table; and providing a plurality of light-sensitive detectors comprising one of a plurality of Cadmium Cell detectors and first ends of a plurality of fiber-optic cables.

12. The method of claim 11 further comprising the steps of coupling a plurality of indicating lights to said plurality of Cadmium Cell detectors, one indicating light per detector, and placing said indicating lights at a location remote from said gaming table.

13. The method of claim 11 further comprising the step of placing second ends of said plurality of fiber-optic cables at a location remote from said gaming table.

14. A security system for use in gaming comprising, in combination:

a gaming table; and means coupled to said gaming table for detecting unauthorized extensions on said gaming table of at least one of a person's hand and an object held by the persons hand; said detecting means comprising one of a plurality of light-sensitive detectors arranged in a pattern on said gaming table and a plurality of fiber-optic cables each having a first end arranged in a pattern on said gaming table.

* * * * *